US005465705A

United States Patent [19]

Baeseman

[11] Patent Number: 5,465,705

[45] Date of Patent: Nov. 14, 1995

[54] PRE-COOKING ASSEMBLY FOR USE WITH AN ARCHERY BOW

[76] Inventor: Clifford E. Baeseman, 862 W. 17th St., Edgar, Wis. 54426

[21] Appl. No.: 255,953

[22] Filed: Jun. 7, 1994

[51] Int. Cl.[6] ..... F41B 5/18

[52] U.S. Cl. ..... 124/88; 124/86; 124/23.1

[58] Field of Search ..... 124/86, 88, 23.1, 124/25.6, 24.1

[56] References Cited

U.S. PATENT DOCUMENTS 4,061,125 12/1977 Trotter .
4,615,326 10/1986 Rathbun .
5,000,154 3/1991 Slayton .
5,002,035 3/1991 Brooks .
5,065,730 11/1991 Kluver .
5,146,908 9/1992 Larson .
5,156,138 10/1992 Grover .

*Primary Examiner*—Anthony Knight
*Attorney, Agent, or Firm*—Richard C. Litman

[57] ABSTRACT

A pre-cocking assembly for an archery bow includes an elongated rod pivotally attached at one end to the riser of a bow, a spring-biased head member rotatably mounted on the other end of the rod, and a spring-biased bowstring retaining member attached to the head member. The retaining member may be positioned to intercept the bowstring when the bowstring is partially drawn, and hold it in that position. When the bowstring is further drawn to fire the arrow, the head member rotates to reposition the bowstring retaining member to a retracted position.

9 Claims, 5 Drawing Sheets

PRE-COOKING ASSEMBLY FOR USE WITH AN ARCHERY BOW

BACKGROUND OF THE INVENTION

1. Field of the Invention

The present invention relates to archery bows, and more particularly to bowstring positioning devices.

2. Description of the Prior Art

Archery bows are physically difficult to cock, aim, and fire due to a large tension of the bow string. When hunting for game, it is a frequent occurrence that between the time a hunter sights the game and properly cocks the bow, the game has disappeared. Consequently, many hunters are forced to hold the bow in a partially cocked condition for great periods of time. This causes great stress on the hunter's muscles.

The prior art includes devices which keep the bow in a partially cocked position in order to address the problem of the archer holding the bow in a partially cocked position for extended periods. However these devices are often cumbersome to set and often react slowly and/or noisily.

U.S. Pat. No. 4,061,125, issued to George H. Trotter on Dec. 6, 1977, discloses a Bowstring Positioning Device which includes a shaft with one end mounted on a bow, and an enlarged padded block attached to the other end of the shaft to receive the bowstring of the bow.

U.S. Pat. No. 4,615,326, issued to Clifford D. Rathbun on Oct. 7, 1986, discloses an Archery Bow Attachment which includes a plate attached to a midpoint on the bow and an elongated rod pivotally connected to the plate at one end. The other end of the rod is adapted to engage the midpoint of the bow string to maintain the bow string in a partially drawn pre-cocked position.

U.S. Pat. No. 5,000,154, issued to James R. Slayton on Mar. 9, 1991, discloses a Pre-Cocking Assembly For Use With A Compound Archery Bow mounted on a riser section of a compound bow. The invention of this patent includes a swing arm that holds the bow string in a partially cocked position, and then moves in a horizontal plane and swings out of the way as soon as the bow string is moved from the partially cocked position towards the fully cocked position.

U.S. Pat. No. 5,002,035, issued to Scott T. Brooks on Mar. 26, 1991, discloses an Archery Bow Cocking Apparatus which includes a forward leg and a nocked aft leg joined together by a spring loaded hinge and offset from the bow by offset angle bends in the forward leg. The spring loaded hinge operates to swing the nocked aft leg away from the bow string on full cocking of the bow string.

U.S. Pat. No. 5,065,730, issued to Ernst P. Kluver on Nov. 19, 1991, discloses an Archery Bow String Prop which includes an elongated, rigid member having an inner end adapted to frictionally engage the handle portion of the bow and an other end adapted to engage the bow string to hold the string in a drawn condition. As the bow string is drawn slightly further back, the prop falls to the ground, allowing the release of the string.

U.S. Pat. No. 5,146,908, issued to Marlow W. Larson on Sep. 15, 1992, discloses a Hold-Back System For Bowstring mounted on a support rod attached to the bow handle. The Hold-Back System includes a movable spring-biased arm, biasing means for moving the arm, and attachment means for adjustably mounting the hold-back apparatus on the support rod.

U.S. Pat. No. 5,156,138, issued to Roger Grover on Oct. 20, 1992, discloses an Apparatus For Drawing, Holding, And Releasing Bowstring. The invention of this patent includes a hand graspable bowstring gripping member, an elongated draw bar mounted on the hand graspable member, a guide member mountable on the bow for slidably receiving and guiding the draw bar for movement in a to-and-fro reciprocal path of travel relative to the bow between an inoperative position and a rearward bowstring drawing position, and a lock member for detachably holding the draw bar in the rearward bowstring drawing position.

None of the above inventions and patents, taken either singly or in combination, is seen to describe the instant invention as claimed.

SUMMARY OF THE INVENTION

The present invention is pre-cocking assembly for use with an archery bow which includes an elongated rod having one end pivotally connected to the riser of the archery bow. A spring-biased head member is rotatably mounted on the other end of the rod. The head member includes a bowstring retaining portion which allows the bowstring to be held in a partially cocked position. When the archer fully retracts the bowstring for firing of an arrow, the spring biased head rotates 180 degrees to quietly retract the bowstring retaining portion to a position where it will not interfere with the released bowstring or arrow.

Accordingly, it is a principal object of the invention to provide a quick acting pre-cocking assembly for use with an archery bow.

It is another object of the invention to provide a quiet acting pre-cocking assembly for use with an archery bow.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
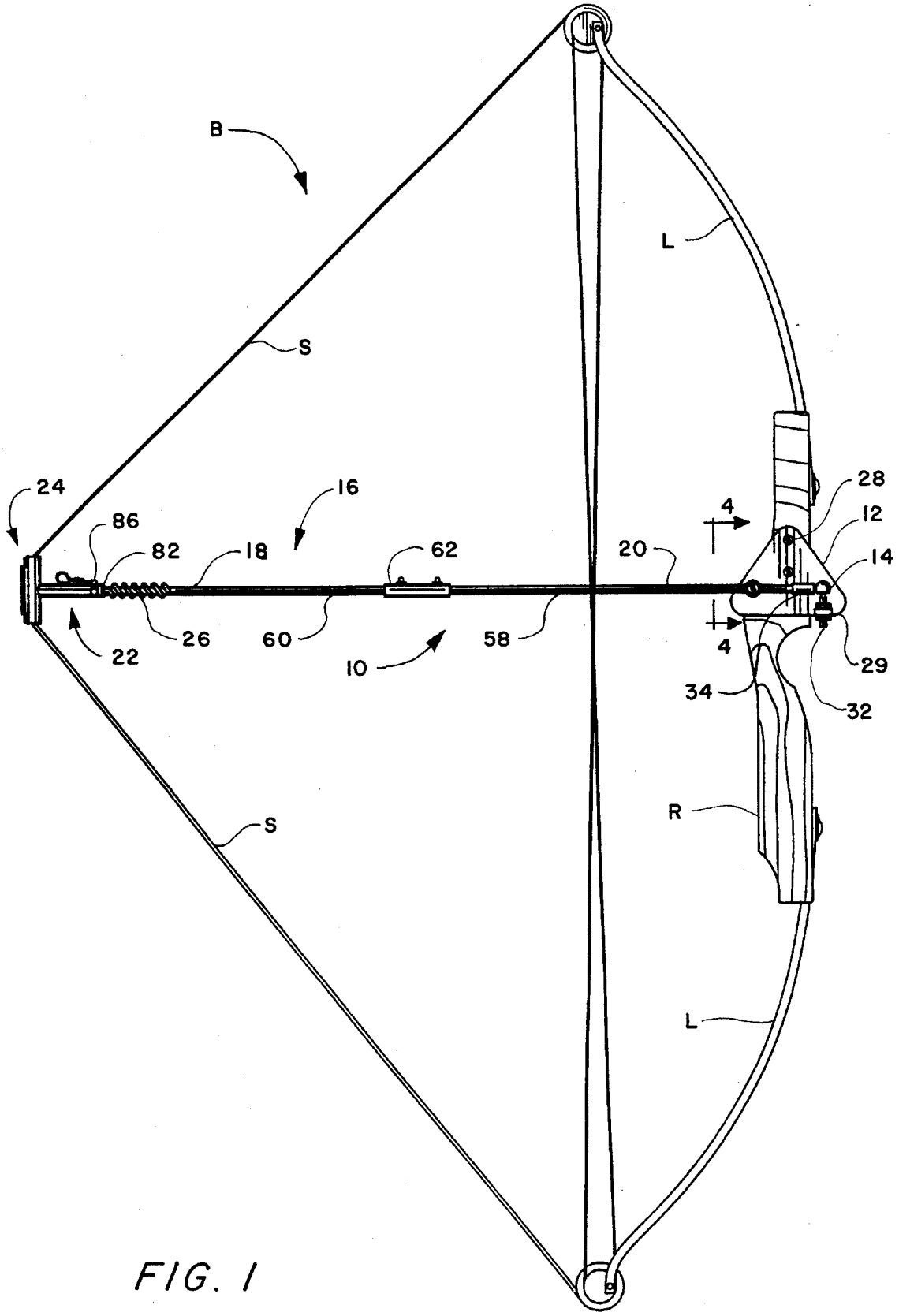
FIG. 1 is a left side view illustrating the assembly according to the present invention mounted on an archery bow, with bowstring held in the pre-cocked position.

The present invention illustrated in FIG. i is a pre-cocking assembly 10 for a compound archery bow B having a handle or riser R, limbs L extending from the riser R, and a bowstring S extending from one limb to the other. The pre-cocking assembly 10 includes a plate 12 attached to a riser R of the archery bow B, a ball and socket assembly 14 attached to the plate 12, an elongated rod 16 with a head end 18 and opposite bow end 20 connected to the ball and socket assembly 14, a head member 22 rotatably mounted on the elongated rod 16, and a bowstring retaining member 24 attached to the head member 22. The bowstring retaining member 24 retains the bowstring S in a partially drawn position until the user is ready to shoot an arrow (not shown). As explained in greater detail below, when the archer further draws the bowstring for firing the arrow, a biasing means 26 motivates the bowstring retaining member 24 to rotate 180 degrees to a retracted position where it will not interfere with the released bowstring or an arrow on the bowstring.

Figure 2:
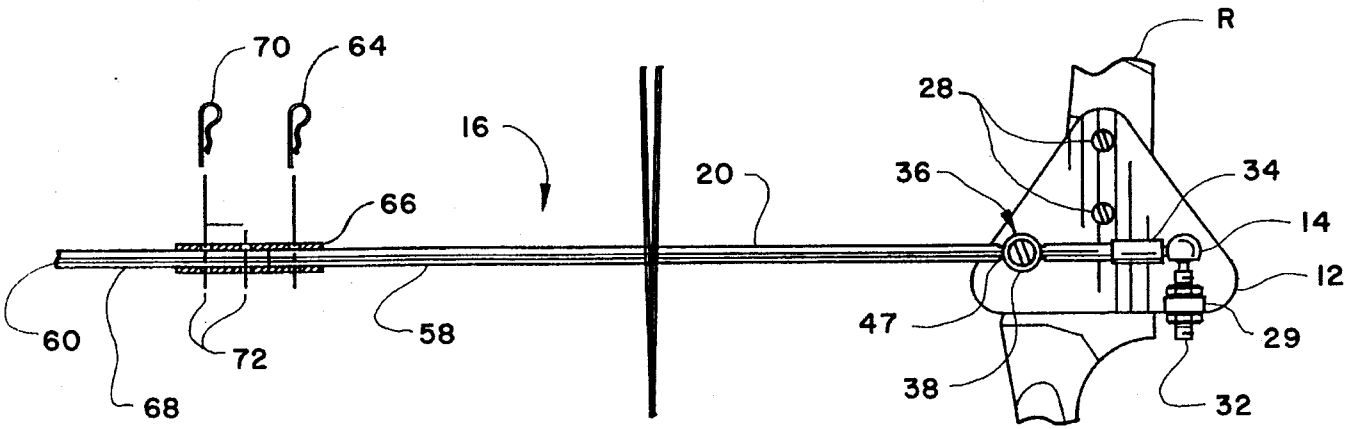
FIG. 2 is an enlarged partial left side view illustrating the attachment plate connected to the elongated rod of the present invention.
Figure 3:
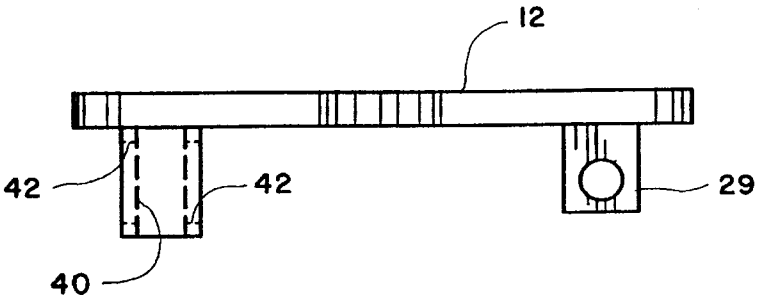
FIG. 3 is a top plan view of the attachment plate.

As shown in FIGS. 1, 2, and 3, a plate 12 may be attached to the riser R of the bow B using the fastener holes 28 existing in most compound archery bows. A ball and socket assembly 14 is attached to a tab 29 (see FIG. 3) of plate 12 using adjustment screw 32. The adjustment screw 32 allows for vertical adjustment of the ball and socket assembly 14. The elongated rod 16 is inserted into and secured at one end into the female portion 34 of the ball and socket assembly 14. The elongated rod 16 extends from the riser R in the direction of the bowstring S.

Figure 5:
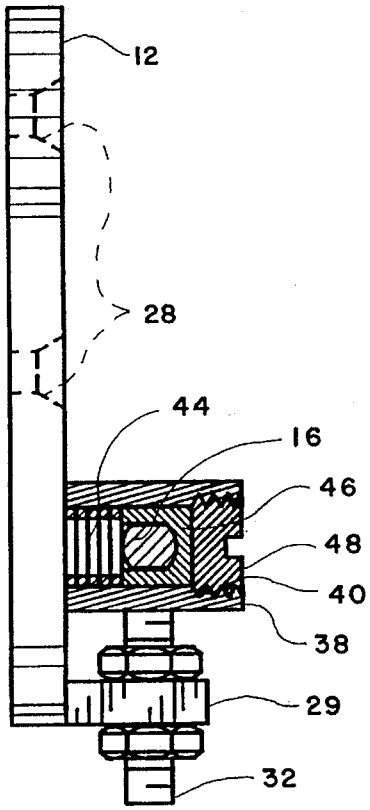
FIG. 5 is a partial cross-sectional rear view of the lateral adjustment member holding the elongated rod in place.
Figure 4:
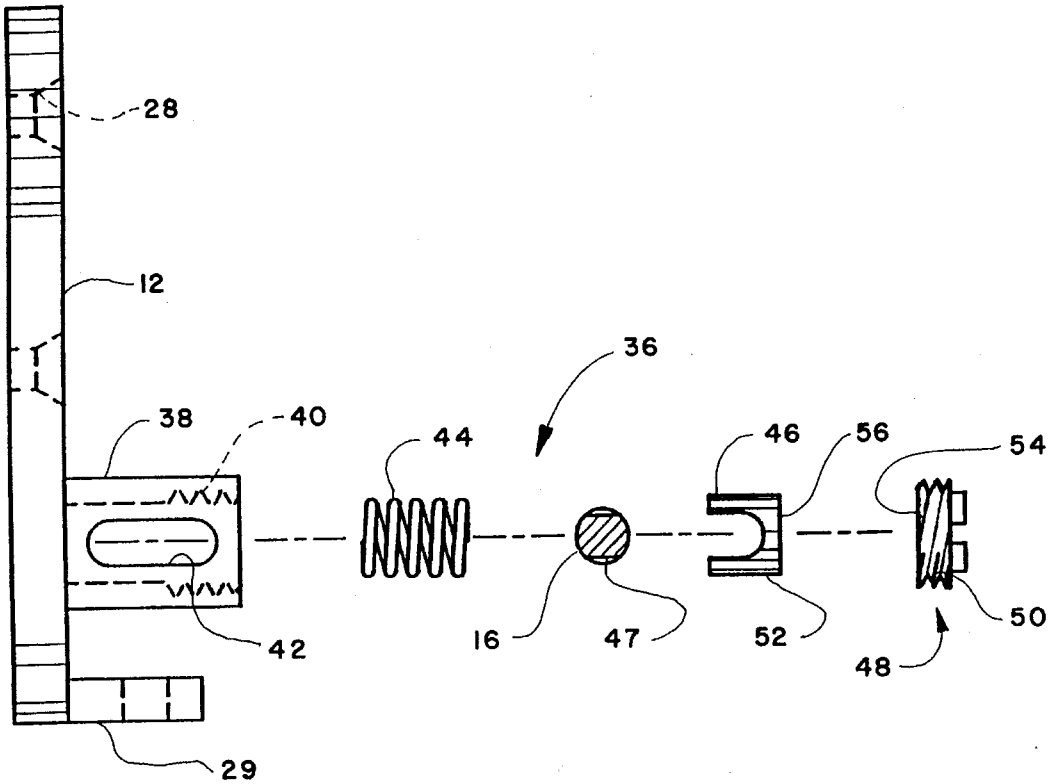
FIG. 4 is an exploded rear view of the lateral adjustment member attached to the connection plate.

As shown in FIGS. 4 and 5, the angle between the rod 16 and the plate 12 may be adjusted using the lateral adjustment means 36 attached to the plate 12. The lateral adjustment means 36 includes an internally threaded adjustment tube 38 extending from the plate 12 to terminate in a tube opening 40, two longitudinal slots 42 which extend through opposite sidewalls of the adjustment tube 38, an adjustment spring 44 within the tube 38, a rod engaging member 46 dimensioned to slide within the adjustment tube 38, and a screw member 48 with external threads 50. In use, the adjustment spring 44 is first placed within the tube 38 and against the plate 12. Once the adjustment spring 44 has been placed, the rod 16 is inserted through the slots 42 and secured to the ball and socket assembly 14 as described above. The rod engaging member 46 is then inserted into the adjustment tube 38 with the rod engaging ends or first end 52 of the engagement member 46 securing the rod 16 against the spring 44. For a section 47 of the rod 46, both the top and bottom surfaces are machined flat to prevent rotation of the rod 16 within the rod engaging end 52. The distance between the rod 16 and the plate 12 is adjusted by threading the screw 48 into the tube 38 until the end 54 of the screw 48 abuts the second end 56 of the rod engaging member 46 and compresses the spring 44. The lateral adjustment means 36 in combination with the ball and socket 14 allow for convenient adjustment of the rod 16 to accommodate various bows.

Figure 7:
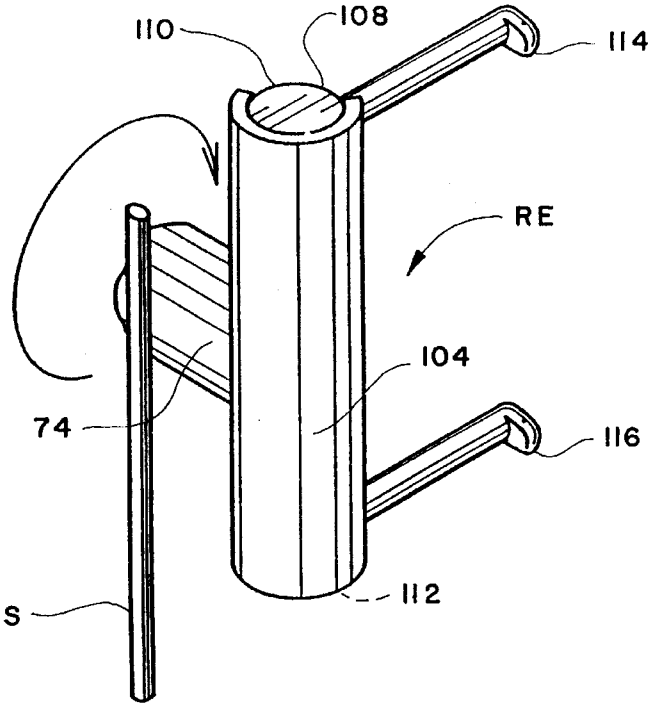
FIG. 7 is a perspective view of the head member rotated to the retracted position.
Figure 8:
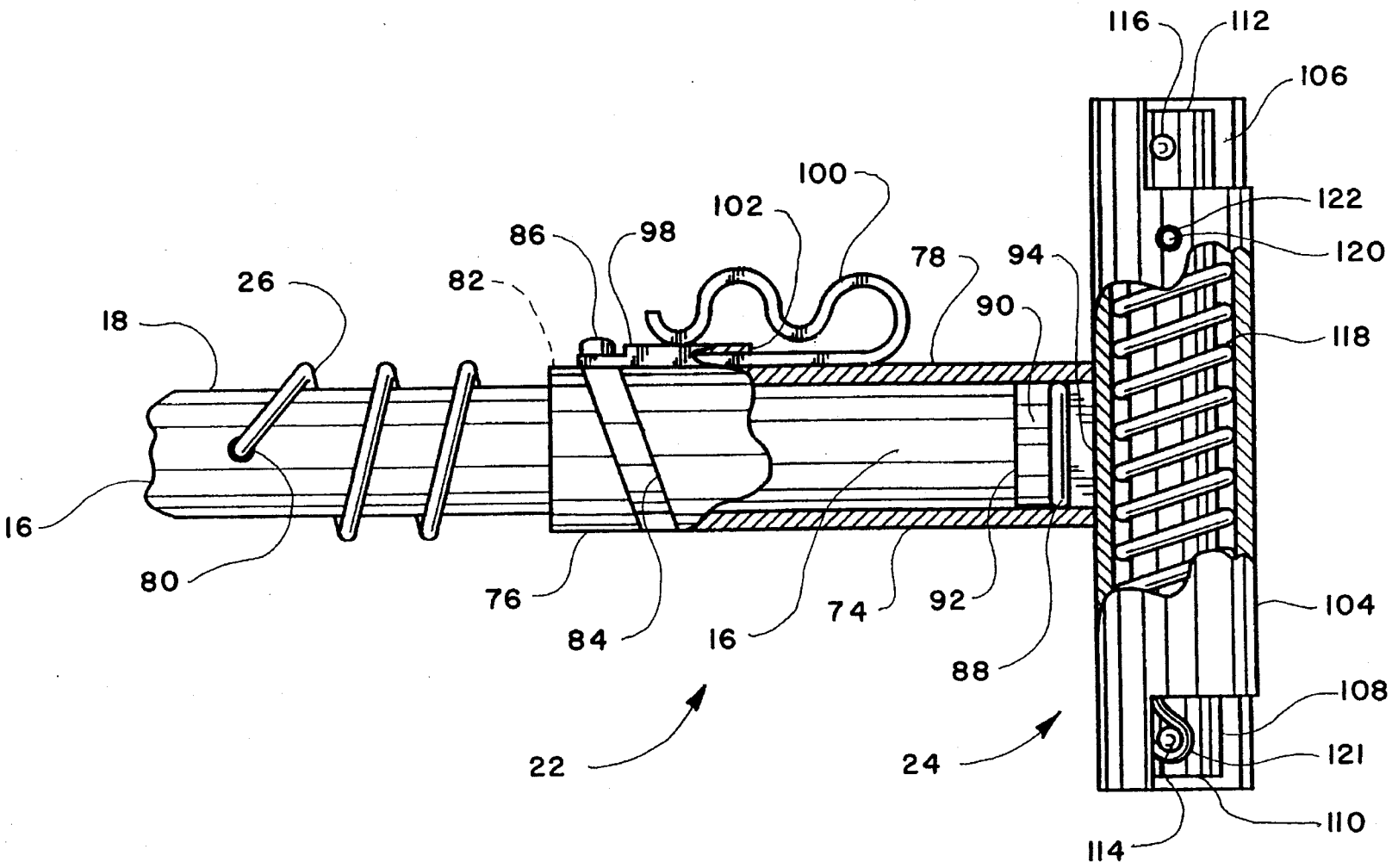
FIG. 8 is a right side view, partly in section, of the head member.

The rod 16 may be either a single member or include a first rod 58 and second rod 60 joined by a connecting sleeve 62 as shown in FIG. 2. A pin 64 is inserted through the sleeve 62 and through the first rod 58 to secure the first end 66 of the first rod 58 within one end of the sleeve 62. A second end 68 of the second rod 60 is secured within the other end of the sleeve 62 by inserting an another pin 70 through the sleeve 62 and the second rod 60. The second rod 60 and the corresponding end of the sleeve include several pin openings 72; these pin openings allow adjustment of the overall length of the rod 16 by adjusting the portion of the second rod 60 inserted into the sleeve 62. The sleeve and rod configuration also facilitates the convenient breakdown and storage of the elongated rod Mounted on the head end 18 of the elongated rod 16 is a head member 22 (FIG. 8). The head member 22 includes a rod-accepting tubular portion 74 having a first end 76 and a second end 78, with a bowstring retaining member 24 attached to the second end 78. The first end 76 rotates on the elongated rod 16, allowing the entire head 22 to rotate 180 degrees from a string retaining position SR, as shown in FIG. 6, to a retracted position RE as shown in FIG. 7.

As shown in FIG. 8, a coil spring 26 provides a biasing force to force the head member 22 from the string retaining position SR to the retracted position RE. The coil spring 26 is disposed around the elongated rod 16 with a first coil spring end 80 attached to the head end 18 of the elongated rod 16 as by welding or other conventional means. A second coil spring end 82 (See FIG. 1) is secured to the rod-accepting tubular portion 74 of the head member 22. The coil spring 26 urges the head member 22 to rotate relative to the elongated rod 16, moving the head member 22 from the string retaining position SR to the retracted position RE. As the head member 16 rotates from the string retaining position SR to the retracted position RE, the head member 22 is drawn towards the elongated rod 16 by the interaction of the slanted slot 84 defined in the wall of the rod-accepting tubular portion 74 and the slot pin 86 secured in the elongated rod 16. The head member 22 is drawn towards the rod 16 until the plastic washer 88 and the metal washer 90 within the tube 74 are compressed between the rod end 92 and end wall 94 of the tube 74 to stop the rotation of the head The compression of the washers 88, 90 facilitates a quick and equally quiet stop of the rotating head 22.

As shown in FIG. 8, a locking means 96 secures the head 22 in the string retaining position SR against the biasing force of the spring 26. The head member locking means 96 includes the slot 84 defined in the wall of the rod-accepting tubular portion 74, the roll pin or nylon slot pin 86 secured within a bore of the rod 16 and dimensioned for sliding engagement within the slot 84, an elongated cotter pin housing 98 secured to the rod-accepting tubular portion 74, and a cotter pin 100. The cotter pin 100 slides through a passageway 102 of the housing 98. Once the head member 22 has been rotated to the string retaining position SR, the user engages the locking means 96 by sliding the cotter pin 100 through the housing 98 until the cotter pin 100 engages the slot pin 86. The slot pin 86 prevents the clockwise rotation of the cotter pin 100, housing 98, and head member 22.

Figure 6:
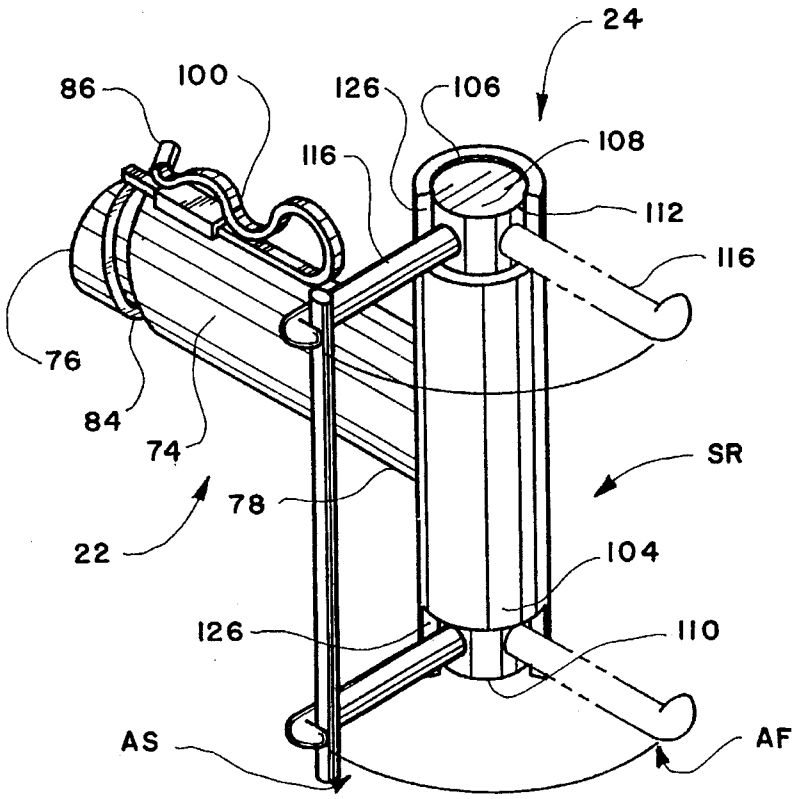
FIG. 6 is a perspective view of the head member in the string retaining position with the retaining arms shown in both the arm-stopped position and arm-flexed position, with the arm-stopped position shown in solid lines and the arm-flexed position shown in phantom lines.

As best shown in FIGS. 6 and 8, the bowstring retaining member 24 retains the bowstring S in a pre-cocked position. The retaining member 24 includes a bolt-bearing tubular housing 104 attached to the second end 78 of the tubular rod-accepting portion 74. The bolt-bearing tubular housing 104 has a bolt bearing passageway 106 and a bolt 108 extending through the passageway 106. The bolt 108 has a first bolt end 110, a second bolt end 112, a first retaining arm 114 extending radially from the first bolt end 110, and a second retaining arm 116 extending radially from the second bolt end 112 and parallel to the first retaining arm 114. The retaining arms 114, 116 are movable from an arm-stopped position AS to an arm-flexed position AF. The retaining arms 114,116 retain the bowstring when the head member 22 is in the string retaining position SR and the retaining arms 114,116 are in the arm-stopped position AS.

As shown in FIG. 8, a bolt spring 118 disposed around the bolt 108 provides the biasing force to motivate the retaining arms 114,116 from the arm-flexed position AF to the arm-stopped AS position. The bolt spring 118 has a first bolt spring end 120 secured within a hole 122 in the bolt bearing tubular housing 104. A second bolt spring end 121 is secured to the base of the first retaining arm 114. The action of the tensioned bolt spring 118 urges the bolt 108 to rotate relative to the bolt-bearing tubular housing 104, moving the retaining arms 114,116 from the arm-flexed position AF back to the arm-stopped position AS. The edges 126 of the bolt-bearing tubular housing 104, serve as a stop to restrict the motion of the retaining arms 114,116 beyond the AS position.

In using the assembly 10, the archer first engages the locking means 96 by sliding the cotter pin 100 through the housing 104 until the cotter pin member 100 engages the slot pin 86 to lock the head member 22 in the string retaining position SR. The archer then draws the bowstring S back until the bowstring S engages and then moves the restraining arms 114,116 from the arm-stopped position AS to the arm-flexed position AF, allowing the bowstring S to be further drawn past the head member 22. Once the bowstring S passes the head member 22, the restraining arms 114,116 return to the arm-stopped position AS and allow the bowstring S to rest in a pre-cocked position against the restraining arms 114,116. The archer then disengages the locking means 96, but the head member 22 remains in the string retaining position SR, due to the bowstring pressure against the restraining arms 114,116. Once the archer draws the bowstring farther, for firing a arrow, the bowstring pressure on the retaining arms 114,116 is withdrawn, allowing the coil spring 26 to urge the head member 22 to rotate to the retracted position RE where it will not interfere with the released bowstring or arrow.

It is to be understood that the present invention is not limited to the sole embodiment described above, but encompasses any and all embodiments within the scope of the following claims.

What is claimed is:

1. A pre-cocking assembly for an archery bow having a bowstring comprising:

an elongated rod having a bow end and a head end;

means for pivotally connecting said bow end of said elongated rod to a midpoint of the archery bow;

a head member, said head member including a rod-accepting tubular portion, said rod-accepting tubular portion including a first end rotatably mounted on said head end of said elongated rod, and a second end opposite said first end, said head member rotatable from a string retaining position to a retracted position free of said bowstring;

head member biasing means for providing force to rotate said head member from the string retaining position to the retracted position;

stopping means for stopping the rotation of said head member at the retracted position;

head member locking means for securing said head member in the string retaining position;

retaining arm means for retaining the bowstring in a precocked position, said retaining arm means attached to said second end of said rod-accepting tubular portion, said retaining arm means movable from an arm-stopped position to an arm-flexed position, whereby said retaining arm means retains the bowstring when said head member is in the string retaining position and said retaining arm means is in the arm-stopped position; and, retaining arm biasing means for providing force to motivate said retaining arm means from said arm-flexed position to said arm-stopped position.

2. The pre-cocking assembly according to claim 1, wherein said head member biasing means includes:

a coil spring disposed around said head end of said elongated rod, said coil spring having a first coil spring end, a second coil spring end, and means for attaching said first coil end to said head end, and means for attaching said second coil spring end to said rod-accepting tubular portion of said head member, whereby said coil spring urges said head member to rotate relative to said elongated rod, moving said head member from the string retaining position to the retracted position.

3. The pre-cocking assembly according to claim 2, wherein said head member locking means for securing said head member in the string retaining position includes:

a slot defined in a wall of said rod-accepting tubular portion of said head member, a slot pin attached to said head end of said elongated rod, said slot pin extending radially from said elongated rod and dimensioned for sliding engagement within said slot, an elongated cotter pin housing attached to said rod-accepting tubular portion of said head member, said cotter pin housing having a cotter pin passageway. therethrough, and a cotter pin member extending through said cotter pin passageway and dimensioned for sliding engagement within said cotter pin passageway, said cotter pin movable from a locked position to an unlocked position, whereby said cotter pin member intersects said slot pin in the locked position to prevent rotation of said head member.

4. The pre-cocking assembly according to claim 1, wherein said retaining arm means including a bolt-bearing tubular housing attached to said second end of said tubular rod-accepting portion, said bolt-bearing tubular housing having a bolt bearing passageway therethrough, a bolt extending through said bolt bearing passageway, said bolt having a first bolt end, a second bolt end, a first retaining arm extending radially from said first bolt end, and a second retaining arm extending radially from said second bolt end and parallel to said first retaining arm.

5. The pre-cocking assembly according to claim 4, wherein said retaining arm biasing means for providing force to motivate said retaining arm means from the arm-flexed position to the arm-stopped position includes a bolt spring having a first bolt spring end attached to said bolt-bearing tubular housing and a second bolt spring end attached to said bolt, whereby said bolt spring urges said bolt to rotate relative to said bolt-bearing tubular housing, moving said first retaining arm and said second retaining arm from the arm-flexed position to the arm-stopped position.

6. The pre-cocking assembly according to claim 1, wherein said means for pivotally connecting said bow end to said elongated rod to a midpoint of the archery bow includes:

a plate attached to a riser of the archery bow, pivot means for pivotally connecting said bow end of said elongated rod to said plate, and lateral adjustment means for adjusting the lateral distance between said head end of said elongated rod and the bowstring.

7. The pre-cocking assembly according to claim 6, wherein said lateral adjustment means includes an internally threaded adjustment tube extending from said plate to terminate to a tube opening, said adjustment tube having a first longitudinal slot extending through a first wall of the said tube, a second longitudinal slot extending through an opposite wall of said tube, said first longitudinal slot and said second longitudinal slot dimensioned to accept said elongated rod, an adjustment spring within said tube, said adjustment spring having a first end and a second end, said first end of said adjustment spring abutting against said plate, a rod engaging member dimensioned to slide within said adjustment tube, said rod engaging member having a rod engaging end and a screw end, and a screw member having external threads dimensioned for threaded engagement into said tube opening of said internally threaded tube, whereby said elongated rod is inserted into said first elongated slot and through second elongated slot with said second end of said adjustment spring and said rod engaging end of said rod engaging member securing said rod within said adjustment tube, and the distance of the rod from the plate may be adjusted by threading said screw member into said tube opening to abut against said screw end of said rod engaging member.

8. The pre-cocking assembly according to claim 1, wherein said elongated rod includes:

a first rod member extending from said bow end of said elongated rod to a first rod end, a second rod member extending from a second rod end to said head end of said elongated rod member, and sleeve means for connecting said first rod end of said first rod to said second rod end of said second rod member and adjusting the length of said elongated rod.

9. A pre-cocking assembly for an archery bow having a bowstring comprising:

an elongated rod, said elongated rod including a first rod member having a bow end and a first rod end, a second rod member having a second rod end and a head end, and sleeve means for connecting said first rod end of said first rod to said second rod end of said second rod member and adjusting said length of said elongated rod;

means for pivotally connecting said bow end of said elongated rod to a midpoint of the archery bow, said means including a plate attached to a riser of the archery bow, pivot means for pivotally connecting said bow end of said elongated rod to said plate, and lateral adjustment means for adjusting the lateral distance between said head end of said elongated rod and the bowstring;

a head member, said head member including a rod-accepting tubular portion, said rod-accepting tubular portion including a first end rotatably mounted on said head end of said elongated rod, and a second end opposite said first end, said head member rotatable from a string retaining position to a retracted position free of said bowstring;

head member biasing means for providing force to motivate said head member from the string retaining position to the retracted position, said head member biasing means including a coil spring disposed around said head end of said elongated rod, said coil spring having a first coil spring end, a second coil spring end, means for attaching said first coil end to said head end, and means for attaching said first coil end to said head end, and means for attaching said second coil spring end to said rod-accepting tubular portion of said head member, whereby said coil spring urges said head member to rotate relative to said elongated rod, moving said head member from the string retaining position to the retracted position;

stopping means for stopping the rotation of said head member at the retracted position;

head member locking means for securing said head member in the string retaining position, said head member locking means including a slot defined in a wall of said rod-accepting tubular portion of said head member, a slot pin attached to said head end of said elongated rod, said slot pin extending radially from said elongated rod and dimensioned for sliding engagement within said slot, an elongated cotter pin housing attached to said rod accepting tubular portion of said head member, said cotter pin housing having a cotter pin passageway therethrough, and a cotter pin member extending through said cotter pin passageway and dimensioned for sliding engagement within said cotter pin passageway, said cotter pin movable from a locked position to an unlocked position, whereby said cotter pin member intersects said slot pin in the locked position to prevent rotation of said head member;

retaining arm means for retaining the bowstring in a precocked position, said retaining arm means attached to said second end of said rod-accepting tubular portion, said retaining arm means movable from an arm-stopped position to an arm-flexed position, whereby said retaining arm means retains the bowstring when said head member is in the string retaining position and said retaining arm means is in the arm-stopped position, said retaining arm means including a bolt-bearing tubular housing attached to said second end of said tubular rod-accepting portion, said bolt-bearing tubular housing having a bolt bearing passageway therethrough, a bolt extending through said bolt bearing passageway, said bolt having a first bolt end, a second bolt end, a first retaining arm extending radially from said first bolt end, and a second retaining arm extending radially from said second bolt end and parallel to said first retaining arm; and, retaining arm biasing means for providing force to motivate said retaining arm means from said arm-flexed position to said arm-stopped position, said retaining arm biasing means including a bolt spring having a first bolt spring end attached to said bolt-bearing tubular housing and a second bolt spring end attached to said bolt, whereby said bolt spring urges said bolt to rotate relative to said bolt-bearing tubular housing, moving said first retaining arm and said second retaining arm from the arm-flexed position to the arm-stopped position.

* * * * *